US009263215B2

(12) United States Patent
Lai

(10) Patent No.: US 9,263,215 B2
(45) Date of Patent: Feb. 16, 2016

(54) TOOL AND METHOD FOR SWITCHING AN ELECTROMAGNETIC RELAY

(71) Applicant: Schneider Electric Industries SAS, Rueil-Malmaison (FR)

(72) Inventor: Lim Kean Lai, Singapore (SG)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 0 days.

(21) Appl. No.: 14/025,910

(22) Filed: Sep. 13, 2013

(65) Prior Publication Data

US 2014/0077907 A1 Mar. 20, 2014

(30) Foreign Application Priority Data

Sep. 17, 2012 (SG) ..... 201206889-6

(51) Int. Cl.

| | |
|---|---|
| ***H01H 51/22*** | (2006.01) |
| ***H01H 50/00*** | (2006.01) |
| ***H01H 1/00*** | (2006.01) |
| ***H01H 50/32*** | (2006.01) |
| *H01H 50/64* | (2006.01) |

(52) U.S. Cl.

CPC ..... *H01H 50/00* (2013.01); *H01H 1/0015* (2013.01); *H01H 50/32* (2013.01); *H01H 50/326* (2013.01); *H01H 50/642* (2013.01)

(58) Field of Classification Search

CPC ..... H01H 51/22; H01H 67/02
USPC ..... 335/78, 186
See application file for complete search history.

(56) References Cited

U.S. PATENT DOCUMENTS

| | | | | | |
|---|---|---|---|---|---|
| 3,622,925 | A | * | 11/1971 | Rose | 335/186 |
| 3,711,749 | A | * | 1/1973 | Koblents et al. | 361/194 |
| 3,740,682 | A | * | 6/1973 | Schantz | 335/186 |
| 4,453,148 | A | * | 6/1984 | Norakidze et al. | 335/205 |
| 5,003,274 | A | * | 3/1991 | Chikira et al. | 335/83 |
| 5,202,663 | A | * | 4/1993 | Tomono et al. | 335/86 |
| 5,534,834 | A | * | 7/1996 | Hendel | 335/78 |
| 5,574,416 | A | * | 11/1996 | Maruyama et al. | 335/78 |
| 5,701,109 | A | * | 12/1997 | Poulsen | 335/78 |
| 5,883,556 | A | * | 3/1999 | Shutes | 335/57 |
| 6,020,801 | A | * | 2/2000 | Passow | 335/78 |
| 6,023,212 | A | * | 2/2000 | Mader | 335/202 |
| 6,060,969 | A | * | 5/2000 | Hufgard et al. | 335/207 |

(Continued)

FOREIGN PATENT DOCUMENTS

| | | | |
|---|---|---|---|
| CN | 100550246 | C | 10/2009 |
| EP | 1471557 | A2 | 10/2004 |

OTHER PUBLICATIONS

Singapore International Search Report and Written Opinion from corresponding Singapore Application No. 201206889-6 dated Jul. 8, 2014.

*Primary Examiner* — Shawki S Ismail
*Assistant Examiner* — Lisa Homza
(74) *Attorney, Agent, or Firm* — Lando & Anastasi LLP

(57) ABSTRACT

A tool and method for switching an electromagnetic relay may be provided, whereby the tool comprises a switching member capable of moving between a first position and a second position along a path oriented to the relay; wherein movement of the switching member from the first position to the second position is capable of switching a switch state of the electromagnetic relay via a magnetic force exerted by the switching member.

20 Claims, 8 Drawing Sheets

(56) References Cited

U.S. PATENT DOCUMENTS

| | | | | |
|---|---|---|---|---|
| 6,262,647 | B1 * | 7/2001 | Rogers et al. | 335/206 |
| 6,426,689 | B1 * | 7/2002 | Nakagawa et al. | 335/78 |
| 6,608,539 | B2 * | 8/2003 | Nobutoki et al. | 335/78 |
| 6,628,741 | B2 * | 9/2003 | Netzer | 377/21 |
| 6,677,842 | B1 | 1/2004 | Hanke et al. | |
| 6,768,626 | B1 * | 7/2004 | Hemmer | 361/139 |
| 6,922,122 | B2 * | 7/2005 | Saruwatari et al. | 335/202 |
| 6,924,719 | B2 * | 8/2005 | Saruwatari et al. | 335/78 |
| 7,161,104 | B2 * | 1/2007 | Bergh et al. | 200/305 |
| 7,642,884 | B2 * | 1/2010 | Bergh et al. | 335/78 |
| 7,679,476 | B2 * | 3/2010 | Kubono et al. | 335/78 |
| 7,710,224 | B2 * | 5/2010 | Gruner et al. | 335/78 |
| 7,859,371 | B2 * | 12/2010 | Takano | 335/78 |
| 7,994,884 | B2 * | 8/2011 | Kuo | 335/78 |
| 8,102,227 | B2 * | 1/2012 | Fujiwara et al. | 335/78 |
| 8,174,342 | B2 * | 5/2012 | Min et al. | 333/262 |
| 8,823,473 | B2 * | 9/2014 | Fujita et al. | 335/189 |
| 2003/0085784 | A1 | 5/2003 | Weber | |
| 2003/0112103 | A1 * | 6/2003 | Schmelz | 335/128 |
| 2005/0046527 | A1 * | 3/2005 | Chida et al. | 335/78 |
| 2005/0057332 | A1 * | 3/2005 | Nakamura et al. | 335/128 |
| 2005/0264385 | A1 * | 12/2005 | Simon et al. | 335/78 |
| 2006/0226935 | A1 * | 10/2006 | Kon et al. | 335/78 |
| 2006/0226936 | A1 * | 10/2006 | Takeda et al. | 335/78 |
| 2006/0226937 | A1 * | 10/2006 | Takeda et al. | 335/78 |
| 2008/0180197 | A1 * | 7/2008 | Kubono et al. | 335/78 |
| 2010/0117770 | A1 * | 5/2010 | Tan | 335/186 |
| 2011/0210808 | A1 * | 9/2011 | Min et al. | 335/205 |
| 2012/0242435 | A1 * | 9/2012 | Ruan et al. | 335/206 |

* cited by examiner 300
308

302
300
310
301
306

302
300
310
304

302
X'
304

302
Y'
304

300

402
406
404
Y'
300

304
Y
302
X'
310
300

402
406
404
X

TOOL AND METHOD FOR SWITCHING AN ELECTROMAGNETIC RELAY

CROSS-REFERENCE TO RELATED APPLICATION

This application claims the benefit under 35 U.S.C. §119 of Singapore Patent Application No. 201206889-6 filed on Sep. 17, 2012 which is hereby incorporated herein by reference in its entirety for all purposes.

TECHNICAL FIELD

The present invention broadly relates to a tool for switching a magnetic-type relay.

BACKGROUND

Electromagnetic relays are used extensively as electromechanical switches in various applications such as electrical circuit boards, alarms, and sensors etc. Typically, a relay comprises an electromagnet with a soft iron bar, or armature. A movable contact/switch is coupled to the armature such that the contact is held in its normal position by e.g. a return spring. Typically, when the electromagnet is energized, by e.g. a user applying a power source to the relay, a magnetic force overcomes the biasing force provided by the return spring and moves the contact into an alternative position, such that the circuit is either open or connected. When the electromagnet is de-energized, by e.g. a user removing the power source to the relay, the contact returns to and is held in its normal position by the return spring.

In some electromagnetic relays, a lock-down door and test button is provided, where manual or physical manipulation of the relay switch can be provided and the manipulated position of the switch physically retained. The manipulation thus bypasses the effect of the electromagnet within the relay. In other words, some relays are integrated with an assembly which allows for the manual operation of the switch, without having to energize the electromagnet coil. This can allow a user to e.g. debug a system controlled by the relay, without energizing the relay's coil.

However, such integrated lock-down door and test button assemblies are not always present in all electromagnetic relays. Non-provision of such assemblies can be because the presence of such additional assemblies may add to the cost of the electromagnetic relay. Further, such assemblies cannot be easily incorporated in certain types of relays due to size or other constraints defined by industrial standards or user requirements. This is particularly true for a range of relays, typically called slim relays. In relays where the lock-down door and test button assemblies cannot be provided, e.g. in conventional slim relays, there does not exist any means for switching the relay to another state without some form of energizing the coil. This situation is particularly difficult and undesirable given that relays, after manufacturing, are typically encapsulated by a moulding material and the internal components of the relay, such as the coil and armature, are not typically accessible. Furthermore, for debugging purposes, it is also not desired to energize a relay in order to switch its state. For example, relays can be used to control a high-power circuit using a low-power signal, with complete electrical isolation between the control and controlled circuits. During commissioning or debugging of the relay, there are situations where the low power signal supplied to the coil cannot or should not be provided.

Therefore, there exists a need for a tool for switching the state of a relay that seeks to address at least one of the above problems.

SUMMARY

In accordance with a first aspect of the present invention, there is provided a tool for switching a state of an electromagnetic relay comprising, a switching member capable of moving between a first position and a second position along a path oriented to the relay; wherein movement of the switching member from the first position to the second position is capable of switching a switch state of the electromagnetic relay via a magnetic force exerted by the switching member.

The tool may further comprise a detachable member capable of coupling to the relay, the detachable member providing a predefined path thereon that corresponds to said path in proximity to the relay.

The movement of the switching member for switching the switch state of the electromagnetic relay may be performed without energizing the relay.

The movement of the switching member from the first position to the second position may be capable of switching the electromagnetic relay from a normally open (NO) switch state to a normally closed (NC) switch state.

The switching member may comprise a magnet.

The path provided by the detachable member may be adapted to be parallel to a planar surface of the relay The path provided by the detachable member may be defined by a slot channel in the detachable member.

Ends of the path provided by the detachable member may correspond substantially to the first and second positions.

One end of the slot channel may be provided with an alignment cavity to align the switching member for entry into the slot channel.

The detachable member may be capable of coupling to the relay by substantially encasing the relay.

The switching member in the first position may be capable of magnetically affecting an armature coupled to a switch of the relay; and movement of the switching member to the second position may be capable of moving the armature to switch the switch state of the switch.

The tool may be capable of switching the switch state of a slim-type relay.

The tool may be external to the relay.

In accordance with a second aspect of the present invention, there is provided a method for switching a state of an electromagnetic relay, the method comprising, moving a switching member between a first position and a second position along a path oriented to the relay; and switching a switch state of the electromagnetic relay via a magnetic force exerted by the switching member.

The method may further comprise coupling a detachment member to the relay, the detachment member providing a predefined path thereon that corresponds to said path in proximity to the relay.

The method may further comprise moving the switching member and switching the switch state of the electromagnetic relay without energizing the relay.

Moving the switching member from the first position to the second position may be capable of switching the electromagnetic relay from a normally open (NO) switch state to a normally closed (NC) switch state.

The switching member may comprise a magnet.

The path provided by the detachable member may be adapted to be parallel to a planar surface of the relay.

The path provided by the detachable member may be defined by a slot channel in the detachable member.

Ends of the path provided by the detachable member may correspond substantially to the first and second positions.

The method may further comprise providing one end of the slot channel with an alignment cavity to align the switching member for entry into the slot channel.

Coupling the detachable member to the relay may comprise substantially encasing the relay.

The method may further comprise moving the switching member to the second position to move an armature coupled to a switch of the relay to switch the switch state of the switch; wherein the switching member in the first position is capable of magnetically affecting the armature.

The method may further comprise switching the switch state of a slim-type relay.

The switching member may be external to the relay.

BRIEF DESCRIPTION OF THE DRAWINGS

Example embodiments of the invention will be better understood and readily apparent to one of ordinary skill in the art from the following written description, by way of example only, and in conjunction with the drawings, in which.

DETAILED DESCRIPTION

Example embodiments described herein may provide a tool for switching a switch state of an electromagnetic relay without energizing the electromagnetic relay.

In the description herein, a relay can be an energizable coil device that can include, but is not limited to, any device that can be switched/powered on and off such as an electrical relay or other electromechanical switching devices, components or parts. An energization event of an energizable coil device can include, but is not limited to, an electrical powering on/off of the element and/or a mechanical switching on/off of the element.

The terms "coupled" or "connected" as used in this description are intended to cover both directly connected or connected through one or more intermediate means, unless otherwise stated.

Further, in the description herein, the word "substantially" whenever used is understood to include, but not restricted to, "entirely" or "completely" and the like. In addition, terms such as "comprising", "comprise", and the like whenever used, are intended to be non-restricting descriptive language in that they broadly include elements/components recited after such terms, in addition to other components not explicitly recited. Further, terms such as "about", "approximately" and the like whenever used, typically means a reasonable variation, for example a variation of +/−5% of the disclosed value, or a variance of 4% of the disclosed value, or a variance of 3% of the disclosed value, a variance of 2% of the disclosed value or a variance of 1% of the disclosed value.

Furthermore, in the description herein, certain values may be disclosed in a range. The values showing the end points of a range are intended to illustrate a preferred range. Whenever a range has been described, it is intended that the range covers and teaches all possible sub-ranges as well as individual numerical values within that range. That is, the end points of a range should not be interpreted as inflexible limitations. For example, a description of a range of 1% to 5% is intended to have specifically disclosed sub-ranges 1% to 2%, 1% to 3%, 1% to 4%, 2% to 3% etc., as well as individually, values within that range such as 1%, 2%, 3%, 4% and 5%. The intention of the above specific disclosure is applicable to any depth/breadth of a range.

Figure 1A:
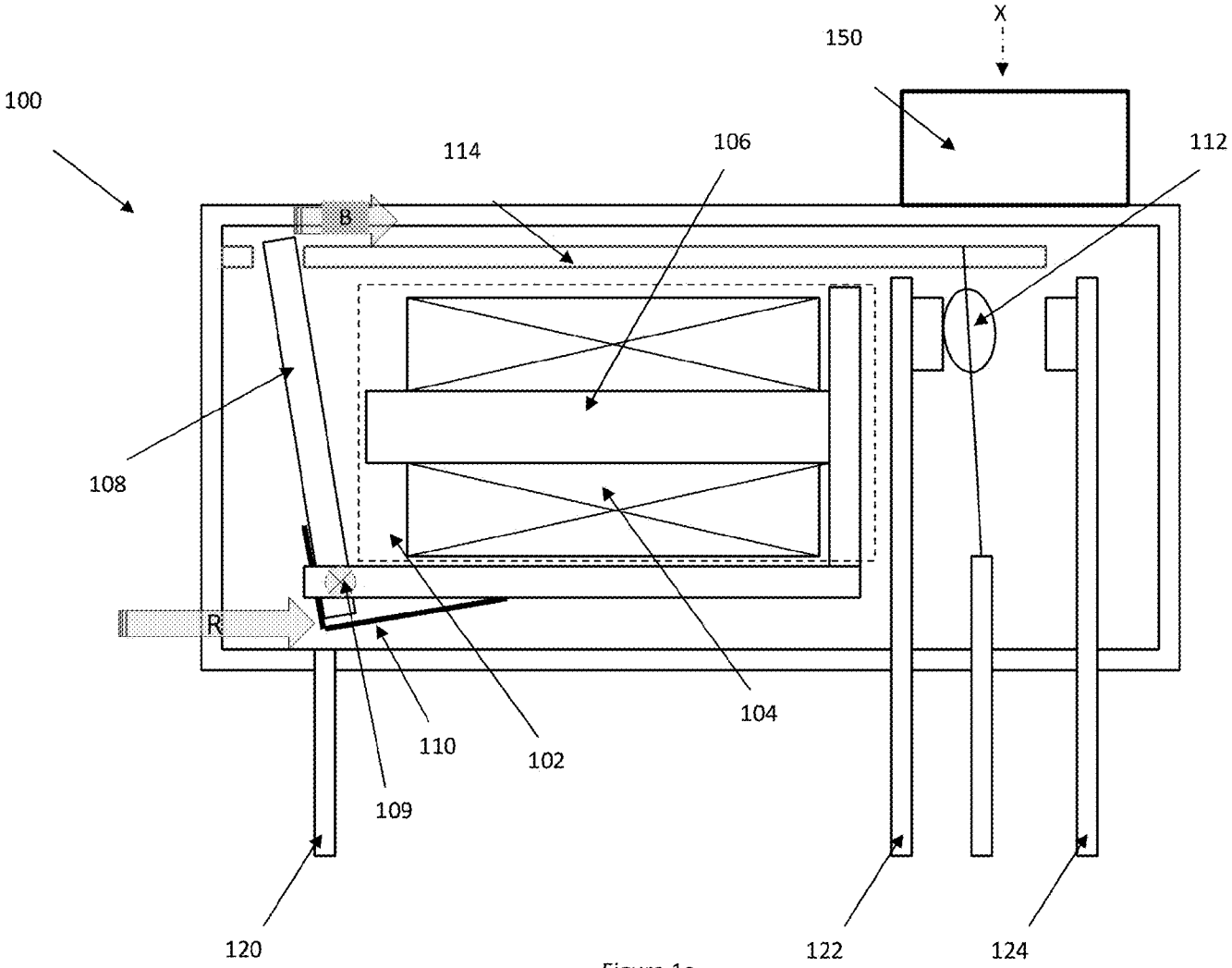
FIGS. 1*a*, 1*b* and 1*c* are schematic drawings for illustrating an interaction between a tool and a relay in an example embodiment.
Figure 1B:
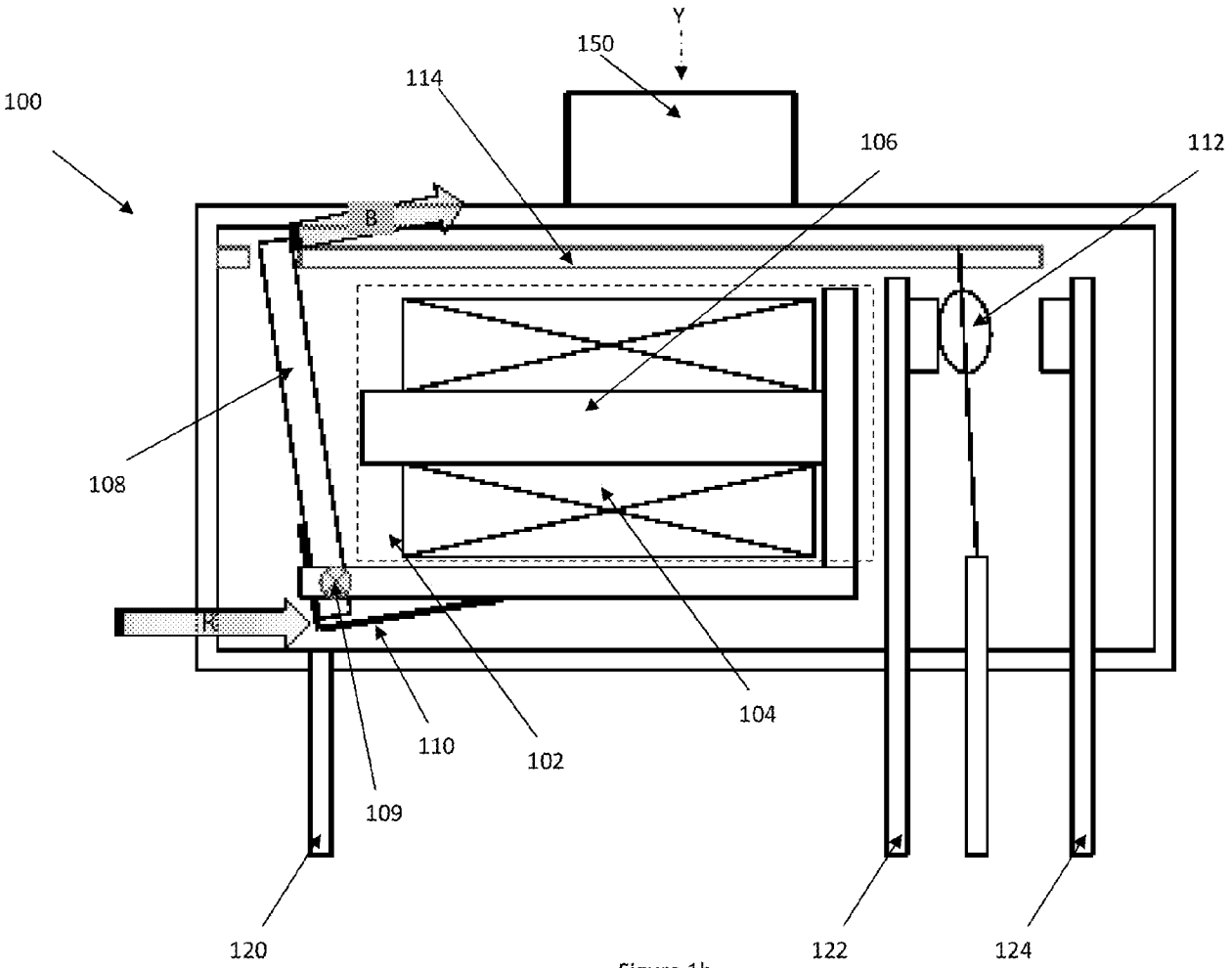
Figure 1C:
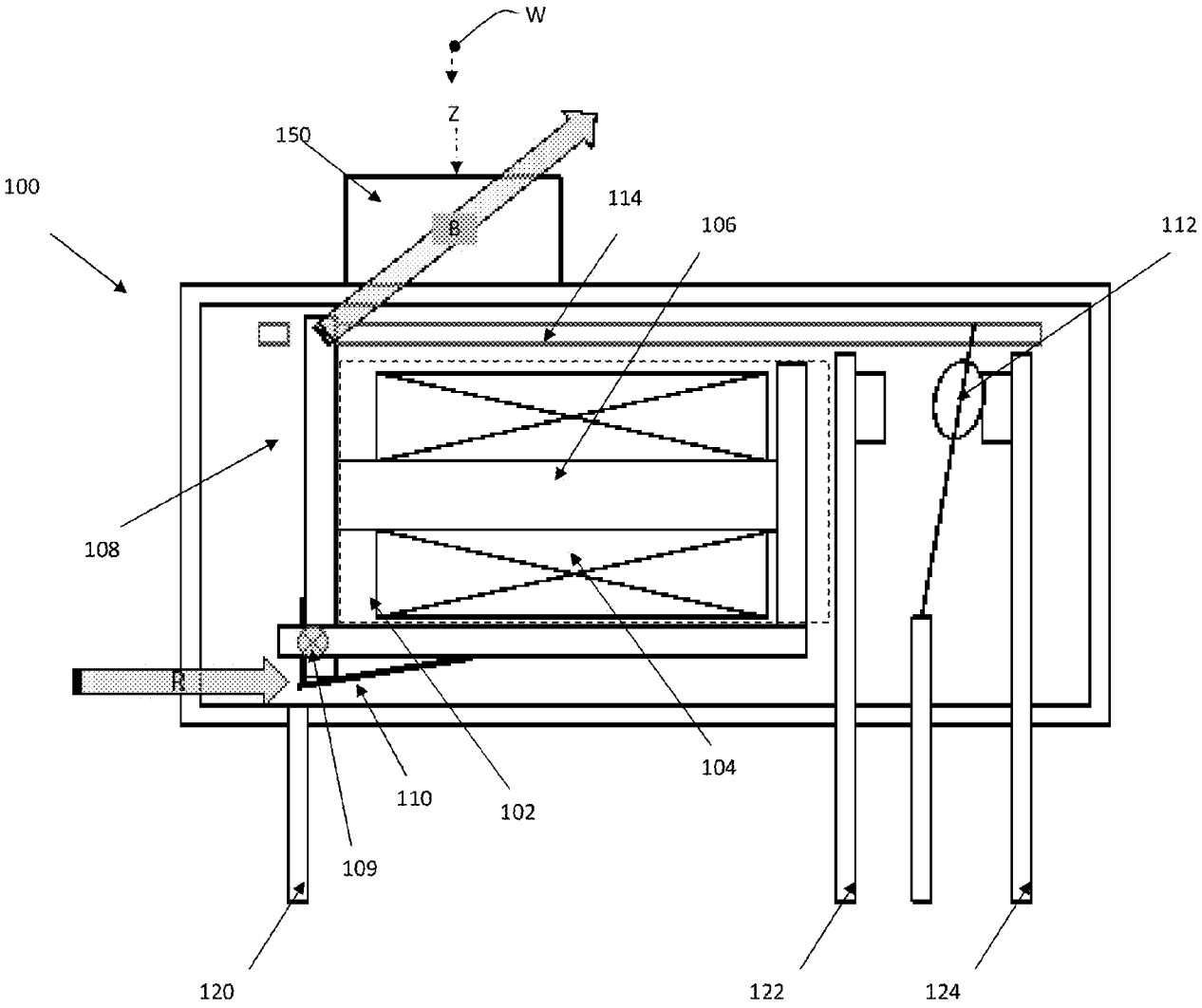

FIGS. 1*a*, 1*b* and 1*c* are schematic drawings for illustrating an interaction between a tool and a relay in an example embodiment. In the example embodiment, the tool 150 functions as a switching member, and the relay is an electromagnetic relay 100. To better illustrate the interaction, certain interior components of the electromagnetic relay 100 are shown in each of FIGS. 1*a*, 1*b* and 1*c*. Further, in FIGS. 1*a*, 1*b* and 1*c*, electrical power is not supplied to the relay 100.

FIG. 1*a* shows the electromagnetic relay 100 in a first switch state. The electromagnetic relay 100 comprises an electromagnet 102 which comprises a coil 104 wound around a magnetic shaft 106. A coil terminal 120 is provided for supplying electrical power to the electromagnet 102. An armature 108 is provided, pivoted at one end 109, such that a free portion of the armature 108 is capable of rotating towards the electromagnet 102. A biasing means e.g. spring 110 is provided, coupled to the armature 108 at the pivoted end 109 of the armature 108, and functions to bias the armature 108 in a default position. In the default position, the armature 108 is biased away from the electromagnet 102. In other words, the spring 110 exerts a force R, which generates an anti-clockwise moment on the armature 108. A movable contact 112 is provided coupled to a free end of the armature 108 via an actuation blade 114. The biasing force provided by the spring 110 retains the armature 108 in its default position which in turn retains the movable contact 112 in its default position, by virtue of coupling to the armature 108 via the actuation blade 114. In the example embodiment illustrated in FIG. 1*a*, the movable contact 112 is biased against and is electrically connected to a NC (Normally-Closed or "Closed") terminal 122 in a default position.

When power is not supplied to the electromagnetic relay 100 via the coil terminal 120, no magnetic force is generated to attract a free portion of the armature 108 towards the electromagnet 102.

For the electromagnetic relay 100, if current (e.g. power) is supplied to the electromagnet 102 via e.g. the coil terminal 120, the current is passed through the coil 104. This in turn energises the shaft 106, effectively transforming shaft 106 into a magnet. The shaft can be made of e.g. soft iron or the like material suitable for magnetization/energization. When energized, the shaft 106 is magnetized and exerts an attractive magnetic force (not shown) on the armature 108. This magnetic force overcomes the biasing force provided by the biasing means or spring 110, to move the armature 108 from the default position to a switched position.

In other words, if the electromagnet 102 is energized, a magnetic force (not shown) is exerted on the armature 108. In the example embodiment, the magnetic force (provided by the energized electromagnet 102) generates a clockwise moment on the armature 108 which can overcome the anti-clockwise moment provided by the spring 110, thus resulting in a clockwise rotation of the armature 108. Accordingly, the movable contact 112 is also moved into a switched position, by virtue of its coupling to the armature 108 via the actuation blade 114. The switched position results in the movable contact 112 being moved to be electrically connected with a NO (Normally-Open or "Open") contact 124 (not shown in FIG. 1*a*).

It has been recognized that most electromagnetic relays are sealed or encapsulated, such that the interior components of the relays, such as the actuation blades or armatures, are not easily accessible or visible. However, the inventors have recognized that a tool comprising a switching member (such as a magnet), can be used to affect the armature position, such that switching of the switch state of the electromagnetic relay can be performed. This tool can be provided external to the relay, such that the relay does not need to be opened or unsealed in order to switch the switch state of the electromagnetic relay. Furthermore, energization of the electromagnet can also be avoided.

As described earlier, FIG. 1*a* shows an electromagnetic relay 100 in a first switch state. The relay is not electrically powered in the example embodiment. A tool 150 for switching the switch state of the electromagnetic relay, without energizing the electromagnetic relay, is also shown. In the example embodiment, the tool 150 comprises a switching member (e.g. a magnet) which is capable of affecting the armature 108, within the electromagnetic relay 100. When the tool 150 is placed in a first position X, with respect to the electromagnetic relay 100, as shown in FIG. 1*a*, the tool 150 exerts a magnetic attractive force B on armature 108 such that a clockwise moment is generated. This clockwise moment may be insufficient to overcome the anti-clockwise moment generated by the spring 110. Thus, the armature 108 remains in its default position. Accordingly, the movable contact 112 is biased against and is electrically connected to the NC ("Closed") terminal 122.

FIG. 1*b* shows the tool 150 in an intermediate position Y, with respect to the electromagnetic relay 100. In this intermediate position Y, the tool 150 is moved nearer to the armature 108. As the tool 150 is moved nearer the armature 108, the tool 150 exerts a larger magnetic attractive force B on the armature 108 such that a larger clockwise moment is generated, as compared to when the tool 150 is in the first position X. This clockwise moment may still be insufficient to overcome the anti-clockwise moment generated by the spring 110. Thus, the armature 108 remains in its default position. Accordingly, the movable contact 114 remains biased against and is electrically connected to the NC ("Closed") terminal 122.

FIG. 1*c* shows the tool 150 in a second position Z, with respect to the electromagnetic relay 100. When the tool 150 is moved in a direction towards the armature 108, the force B and clockwise moment exerted by the tool 150 on the armature 108 is correspondingly increased. At a point in the path from the first position X to the second position Z, aligned to the relay 100, the clockwise moment increases to a value where the force is capable of overcoming the anti-clockwise moment generated by the spring 110. Thus, the armature 108 moves towards the tool 150, which emulates the function of a powered or energized electromagnet 102. The armature 108 is hence in the switched position, and accordingly, the movable contact 112 is moved to a switched position and is electrically connected to the NO ("Open") terminal 124. The second position Z is a position where the tool can exert a sufficient clockwise moment on the armature 108 for the switch state of the electromagnetic relay 100 to be switched. Thus, effectively, the switch state of the electromagnetic relay is switched e.g. from terminals 122 to 124, when the tool 150 is moved from the first position X to the second position Z, along a path aligned to the relay 100. Preferably, the second position Z is a position whereby the tool 150 can exert a substantially maximum clockwise moment on the armature 108 for the switch state of the electromagnetic relay 100 to be switched.

In the example embodiment, the armature 108 is a mechanically moving part, with diamagnetic properties, which can be attracted by magnetic or electromagnetic forces. When the coil 104 is energized, the core (or magnetic shaft 106) acts as an electromagnet and attracts the armature 108 towards itself. The inventors have recognized that the same armature movement can be simulated, by moving the tool 150 in the path from the first position X to the second position Z. As magnetic force is directly proportional to 1/(air gap between the attracting bodies)$^2$, moving the tool 150 from the first position X to the second position Z results in a gradual increase of attraction between the tool 150 and the armature 108. Thus, the armature 108 is attracted to and moves towards the tool 150 as the tool 150 approaches the armature 108, thereby simulating the movement of the armature 108 when the coil is energized sufficiently. In this example embodiment, the second position Z does not need to be accurately defined. That is, the tool 150 does not cause movement of the armature 108, before the tool 150 arrives at the second position Z and switches the state of the relay 100.

In another example embodiment, the tool 150 may be placed directly at the second position Z, without first starting from the first position X. That is, the path oriented to the relay is a path around the second position Z such that the armature 108 is affected and switching occurs. The starting position can be a position W directly vertical to the second position Z, such that moving the tool 150 on the vertical path to position Z causes switching of the relay 100. In this example embodiment, good accuracy of the second position Z can determine the success of the switching operation of the relay 100. If the second position Z is accurately defined, placing the tool 150 directly at the second position Z, can result in the armature 108 being pulled towards the core.

Thus, providing a preferable path showing a first position X and a second position Z can advantageously ensure that the tool 150 functions to attract the armature 108 towards the core 106, for switching of the state of the relay 100 to correctly and more easily occur.

It will be appreciated that there are various ways of implementing the mechanisms of an electromagnetic relay. The electromagnetic relay 100 described in FIGS. 1*a*, 1*b* and 1*c* are for illustrative purposes only and example embodiments herein are not limited for use with the electromagnetic relay described. The inventors have recognized that for each type of relay design, the tool of example embodiments and its use may be modified accordingly. For example, a particular type of electromagnetic relay design may work best with the movement of the switching member from a specific first position to a specific second position and along a specific path. In other words, the switching member (e.g. magnet) of the tool functions to affect the switching armature (e.g. armature 108 of FIG. 1), for the switching member to switch the switch state of the electromagnetic relay.

In an example embodiment, the path may be printed or displayed on an external surface of an electromagnetic relay.

Figure 2:
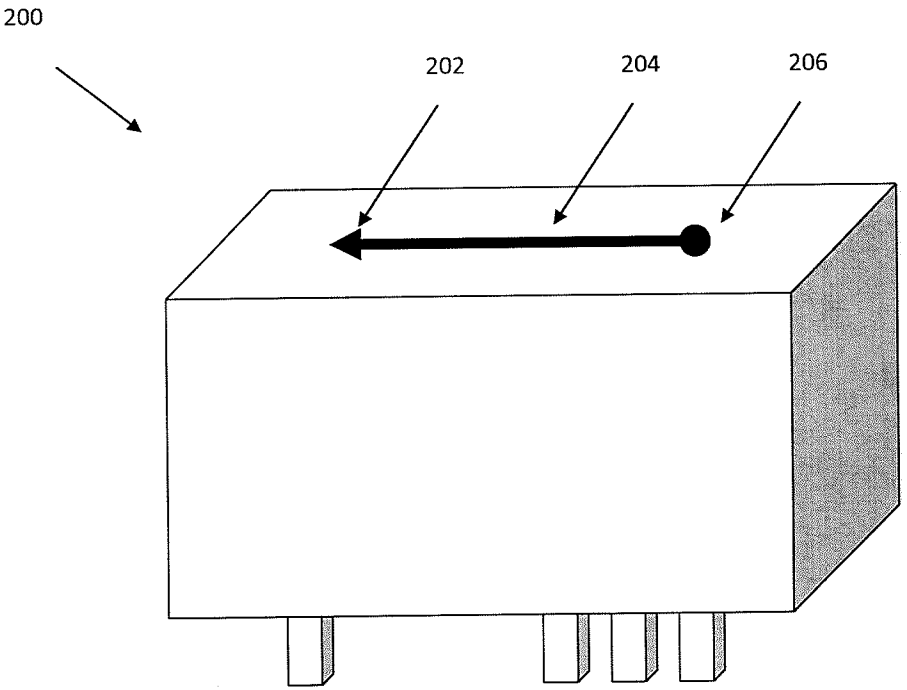
FIG. 2 is a schematic drawing of a relay with a path printed on an external surface in an example embodiment.

FIG. 2 is a schematic drawing of a relay 200 with a path 204 printed on an external surface in an example embodiment. A first position 206 and a second position 202 are shown. The path 204 may be represented as shown in FIG. 2 to more effectively provide a user with an indication of the first and second positions, e.g. where the tool is to be moved from, and where the tool is to move to, in order to switch the switch state of the relay 200. Preferably, the first position 206 may define a position where the tool is not affecting the switch state of the relay 200, and the second position 202 may define a position where the tool can switch the switch state of the relay 200. More preferably, the second position 202 may define a position where the tool can provide a substantially maximum effect to switch the switch state of the relay 200.

FIGS. 3*a* to *e* are schematic drawings showing a tool in another example embodiment. FIGS. 3*a* to 3*e*, collectively show a process of coupling a tool 301 to a relay 300. In this example embodiment, the tool 301 comprises a detachable member 302 and a switching member 304.

Figures 3A, 3B, 3C, 3D, 3E:
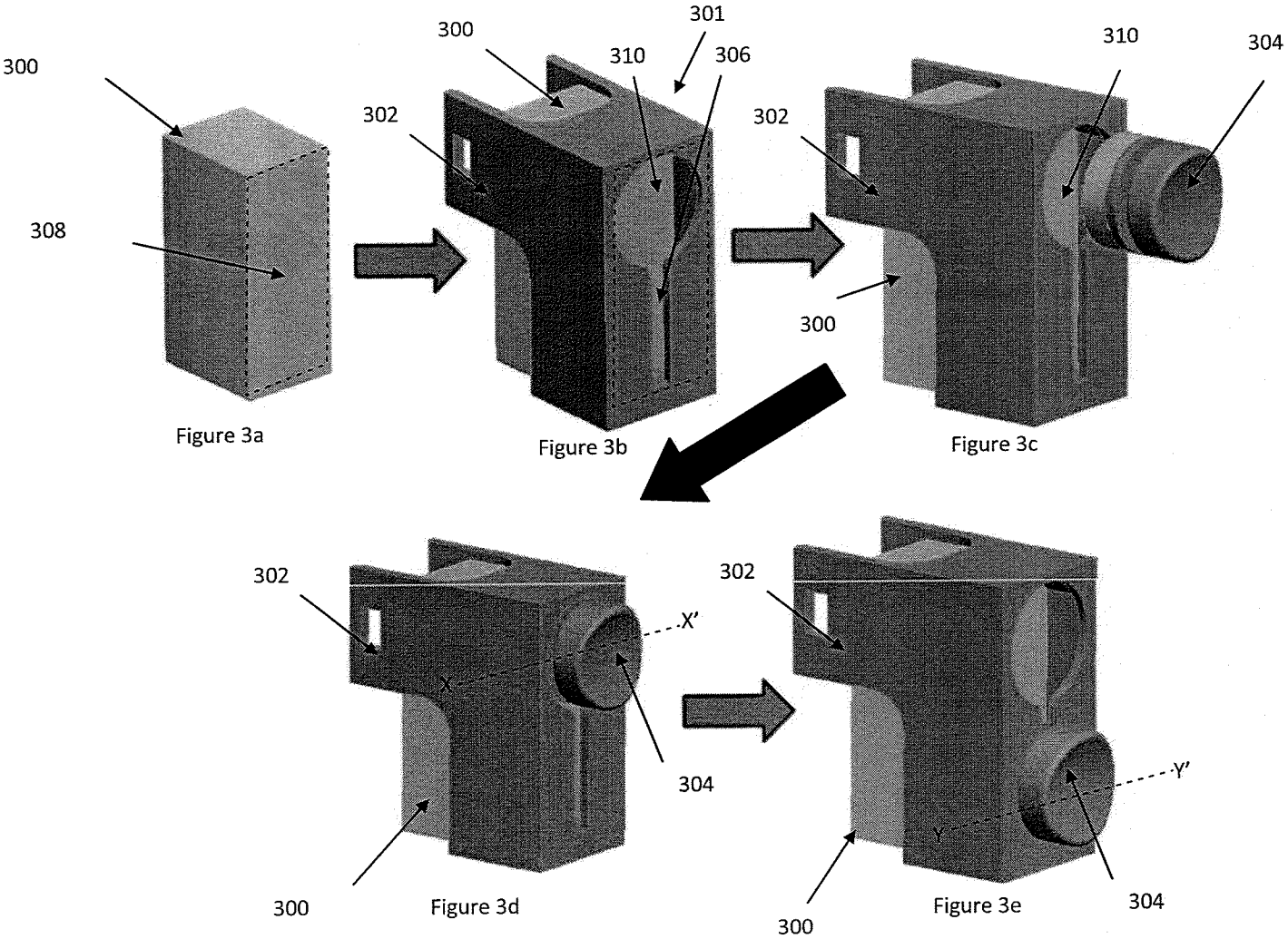
FIGS. 3*a*, 3*b*, 3*c*, 3*d* and 3*e* are schematic drawings showing a tool in another example embodiment.

FIG. 3*a* shows the relay 300. FIG. 3*b* shows a detachable member 302 of the tool 301 being coupled to the relay 300. It is preferred that the detachable member 302 is designed or dimensioned such that it can be rigidly attached to the relay 300, such that when in use, the detachable member 302 is not easily detached from the relay 300 by accident, so as to ensure smooth and/or reliable operations. In the example embodiment as shown in FIG. 3*b*, the relay 300 is substantially encased by the detachable member 302. A predefined path 306 is disposed on or provided within the detachable member 302, and the predefined path 306 is preferably substantially parallel to a planar surface 308 (see FIG. 3*a*) of the relay 300. Therefore, the path 306 is aligned to and in sufficient proximity to the relay 300. The planar surface 308 is an external surface of the relay 300, which the armature (e.g. 108 of FIG. 1) of the relay may be most proximate to, and/or likely to be most affected by the switching member 304 from the exterior of the relay 300. The predefined path 306 is defined by a slot channel in the detachable member 302. On one end of the predefined path 306 is an alignment cavity 310 which is capable of aligning the switching member 304 for entry into the slot channel of the predefined path 306. The end of the path with the alignment cavity 310 may also define the first position so that a user can easily identify a starting point for the switching of the switch state.

FIG. 3*c* shows a switching member 304 for insertion into an alignment cavity 310 disposed on the predefined path 306. FIGS. 3*d* and 3*e* further illustrate the movement of the switching member 304 from a first position (see FIG. 3*d*) to a second position (see FIG. 3*e*) along the path 306 defined by the detachable member 302.

The switching member 304 shown in FIGS. 3*b* to 3*e* comprises thick end sections and a thin middle section (as compared to the end sections). The thick end sections can act to ensure that the switching member 304 can move only along the predefined path 306 defined by the slot channel of the detachable member 302.

Figures 4A, 4B:
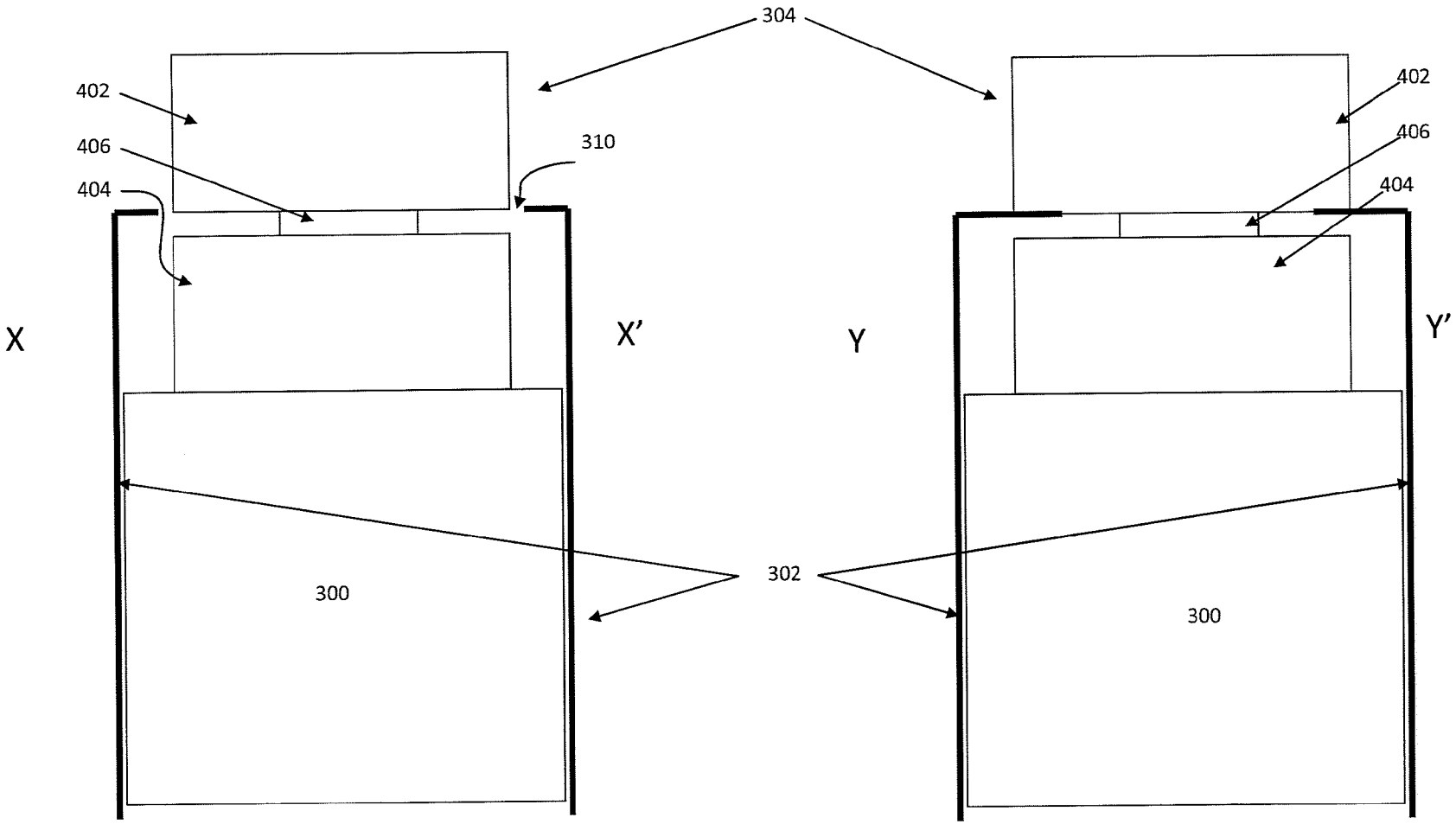
FIG. 4*a* shows a cross-sectional view of the switching member along the line X-X' of FIG. 3*d*.
FIG. 4*b* shows a cross-sectional view of the switching member along the line Y-Y' of FIG. 3*d*.

FIG. 4*a* shows a cross-sectional view of the switching member along the line X-X' of FIG. 3*d*. In this position, the alignment cavity 310 can accommodate the thick end sections 402, 404 of the switching member 304 to be received by and/or inserted into the detachable member 302. However, other than the alignment cavity 310, the width of the slot channel which defines the path 306 is made narrower than the thick end sections 402, 404 of the switching member 304.

FIG. 4*b* shows a cross-sectional view of the switching member along the line Y-Y' of FIG. 3*e*. The thin middle section 406 of the switching member 304 is made smaller than the width of the slot channel. However, the thick end sections are thicker than the slot width. Thus, the switching member 304 can move only along the predefined path 306 defined by the slot channel on the detachable member 302, via traversing at the stem sections provided by the middle section 406, in a manner substantially parallel to the planar surface 308 of the relay 300. The switching member 304 can thus only be inserted into or removed from the detachable member 302 at the alignment cavity 310.

Figures 5A, 5B:
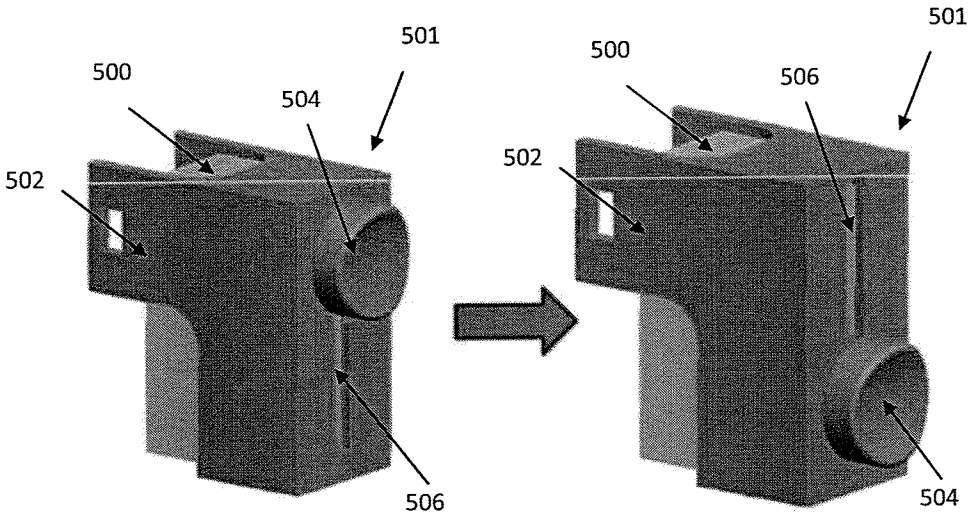
FIGS. 5*a* and *b* are schematic drawings showing a tool in another example embodiment.

FIGS. 5*a* and *b* are schematic drawings showing a tool 501 in another example embodiment. FIGS. 5*a* and 5*b* show the tool 501 comprising a detachable member 502 and a switching member 504, being attached or coupled to the relay 500, with the switching member 504 in first and second positions respectively in the two figures. It is preferred that the detachable member 502 is designed or dimensioned such that it can be rigidly attached to the relay 500, so as to ensure smooth and/or reliable operations. In the example embodiment as shown in FIG. 5*a*, the relay 500 is substantially encased by the detachable member 502. A predefined path 506 is disposed on or provided within the detachable member 502, and the predefined path 506 is preferably substantially parallel to a planar surface (not shown) of the relay 500. Therefore, the path 506 is aligned to and in sufficient proximity to the relay 500. The planar surface is an external surface of the relay 500, which the armature (e.g. 108 of FIG. 1) of the relay may be most proximate to, and/or likely to be most affected by the switching member 504 from the exterior of the relay 500. The predefined path 506 is defined by a slot channel in the detachable member 502.

In this example embodiment, the switching member 504 is engaged to the detachable member 502 such that it cannot be separated or removed from the detachable member 502. The detachable member 502 does not comprise of any alignment cavities which can allow the switching member 504 to be inserted or removed from the slot channel.

In example embodiments, it is beneficial for a switching member to begin movement from a first e.g. "OFF" position, before it is moved/switched to a second e.g. "ON" position to switch a switch state of a relay. This is accomplished without energization of the relay. Thereafter, once debugging is completed, it is desirable for the switching member to switch the relay "OFF" by returning the switching member to the first position before the switching member is removed. Thus, the asymmetrical design (e.g. of a slot path with an alignment cavity end) can further advantageously provide "poka yoke" functions, to ensure that the switching member is only inserted and removed from one end of the path.

Example embodiments can provide a tool for allowing the switching status of an electromagnetic relay to be switched via an external switching member. This can advantageously allow a user to perform debugging of e.g. particular devices controlled by a relay, without electrically powering the electromagnetic relay or energizing the electromagnet within the relay. This can be particularly useful when the relay is not equipped with a lock-down lever or test button bypass functions.

The tool may comprise a switching member which can affect the armature of comprised within the electromagnetic relay, such that the switch state of the relay can be switched. In some example embodiments, the tool may be further provided with a detachable member which can substantially rigidly couple to the relay. This can advantageously provide a stable base from which the switching member can perform reliable switching of the relay. This can be particularly useful when used in unstable environments where vibrations and the like are common. The detachable member may also be advantageously provided with "poka yoke" design elements to ensure that the switching member is allowed to be removed only in a safe position.

Figure 6:
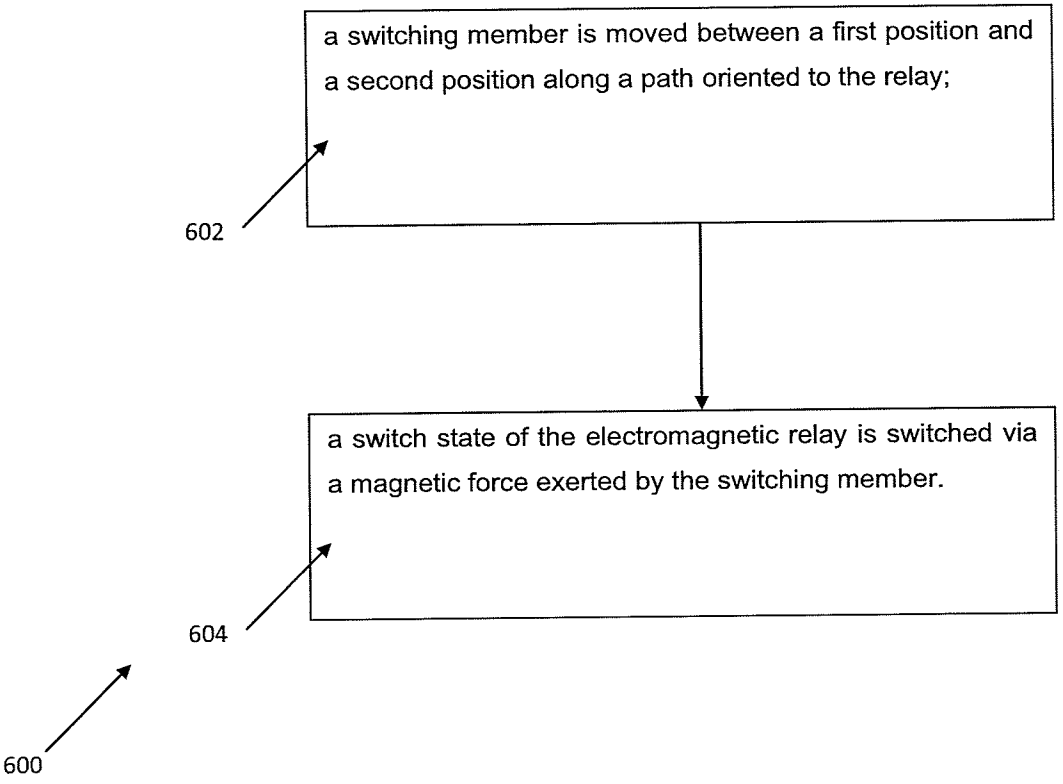
FIG. 6 is a schematic flow chart for illustrating a method for switching a state of an electromagnetic relay in an example embodiment.

FIG. 6 is a schematic flow chart 600 for illustrating a method for switching a state of an electromagnetic relay in an example embodiment. At step 602, a switching member is moved between a first position and a second position along a path oriented to the relay. At step 604, a switch state of the electromagnetic relay is switched via a magnetic force exerted by the switching member.

It will be appreciated by a person skilled in the art that other variations and/or modifications may be made to the specific embodiments without departing from the spirit or scope of the invention as broadly described. The present embodiments are, therefore, to be considered in all respects to be illustrative and not restrictive.

The invention claimed is:

1. A tool for switching a state of an electromagnetic relay comprising:

a switching member configured to move between a first position and a second position along a path, wherein the tool is configured such that movement of the switching member from the first position to the second position causes a change of a switch state of the electromagnetic relay via a magnetic force exerted by the switching member, wherein the electromagnetic relay includes a movable contact coupled to an end of an armature through an actuation blade, and wherein the tool is configured such that the magnetic force causes movement of the armature.

2. The tool of claim 1, further comprising:

a detachable member configured to couple to the relay, the detachable member providing a predefined path thereon that corresponds to the path.

3. The tool of claim 2, wherein the path provided by the detachable member is adapted to be parallel to a planar surface of the relay.

4. The tool of claim 2, wherein the path provided by the detachable member is defined by a slot channel in the detachable member.

5. The tool of claim 4, wherein one end of the slot channel is provided with an alignment cavity to align the switching member for entry into the slot channel.

6. The tool of claim 2, wherein ends of the path provided by the detachable member correspond substantially to the first position and the second position.

7. The tool of claim 2, wherein the detachable member is configured to couple to the relay by substantially encasing the relay.

8. The tool of claim 1, wherein the tool is configured to change a switch state of the electromagnetic relay without energizing the relay.

9. The tool of claim 8, wherein movement of the switching member from the first position to the second position is configured to switch the electromagnetic relay from a normally open (NO) switch state to a normally closed (NC) switch state.

10. The tool of claim 1, wherein the switching member includes a magnet.

11. The tool of claim 1, wherein the switching member in the first position is configured to magnetically affect the armature, wherein the armature is coupled to a switch of the relay, and wherein movement of the switching member to the second position is configured to move the armature to change the switch state of the switch.

12. The tool of claim 1, wherein the tool is configured to change the switch state of a slim-type relay.

13. The tool of claim 1, wherein the tool is external to the relay.

14. A method for switching a state of an electromagnetic relay, the method comprising:

moving a switching member between a first position and a second position along a path; and switching a switch state of the electromagnetic relay via a magnetic force exerted by the switching member, wherein the magnetic force causes movement of an armature coupled to a movable contact through an actuation blade.

15. The method of claim 14, further comprising coupling a detachable member to the relay, the detachable member configured to define the path.

16. The method of claim 15, wherein coupling the detachable member to the relay comprises substantially encasing the relay.

17. The method of claim 14, further comprising moving the switching member and switching the switch state of the electromagnetic relay without energizing the relay.

18. The method of claim 14, further comprising:

moving the switching member to the second position to move the armature to change the switch state of a switch, wherein the switching member in the first position is configured to magnetically affect the armature.

19. The method of claim 14, wherein switching a switch state of the electromagnetic relay via a magnetic force exerted by the switching member includes switching a switch state of a slim-type relay.

20. The method of claim 14, wherein moving a switching member between a first position and a second position along a path further includes the switching member being external to the relay.

* * * * *